United States Patent [19]

Collins

[11] Patent Number: 4,664,441

[45] Date of Patent: May 12, 1987

[54] IMPROVEMENTS IN OR RELATING TO AIDS FOR THE DISABLED

[75] Inventor: Donald E. Collins, Pontypool, United Kingdom

[73] Assignee: Carters (J & A) Limited, United Kingdom

[21] Appl. No.: 749,945

[22] Filed: Jun. 27, 1985

[30] Foreign Application Priority Data

Jun. 28, 1984 [GB] United Kingdom ..... 8416485

[51] Int. Cl.[4] ..... A47C 4/52

[52] U.S. Cl. ..... 297/183; 297/DIG. 4

[58] Field of Search ..... 297/34, DIG. 4, 46, 297/183; 403/92, 91; 16/277; 248/158, 439, 116, 188.6; 108/115

[56] References Cited

U.S. PATENT DOCUMENTS

| | | | |
|---|---|---|---|
| 2,556,995 | 6/1951 | Coffing | 403/92 |
| 4,113,307 | 9/1978 | Day | 297/183 |
| 4,164,354 | 8/1979 | Rodaway | 297/183 |
| 4,479,665 | 10/1984 | Kassai | 403/92 |

*Primary Examiner*—James T. McCall

*Attorney, Agent, or Firm*—Basile, Weintraub & Hanlon

[57] ABSTRACT

A folding backrest of a wheelchair has two attendant handles fixed to upper tubes hinged to vertical lower tubes so as to be turnable into lowered positions. Supported on the upper tubes are respective cams turnable rearwardly by an attendant about a horizontal axis and in opposition to springs, from positions in which they bear against horizontal pins fixed at the rears of the lower tubes and maintain the upper tubes in their raised positions, into positions which allow them to be lowered past the pins to permit the backrest to be lowered.

7 Claims, 2 Drawing Figures

IMPROVEMENTS IN OR RELATING TO AIDS FOR THE DISABLED

BACKGROUND OF THE INVENTION

1. Field of the Invention

This invention relates to an aid for the disabled, for example to a folding backrest of a wheelchair.

2. Description of the Prior Art

Folding wheelchairs are commonly carried from place to place in motor cars, so that a patient may become mobile at his destination.

It is conventional for substantially the whole, or an upper part of, the backrest of a folding wheelchair to hinge down rearwardly to decrease the overall height of the wheelchair for easy accommodation of the wheelchair in a back seat or a boot of a motor car.

For example, it is known from British Patent Specification No. 1175684 for two side frames of a folding wheelchair to include two rear upper and two rear vertical lower side tubes, with a strip of canvas or like material extending between the two upper tubes as a rest for the patient's back. The two upper tubes are connected by rear hinges to the respectively lower tubes so that they can be turned down rearwardly from raised conditions in which their lower ends extend vertically upwards from the lower tubes and their remainders extend almost vertically upwards but slightly rearwardly. The two upper tubes are releasably held in their raised positions by respective latching pins which are spring-biassed into positions in which they project as sliding fits out of the lower ends of reinforcing bushes fixed in the lower ends of the upper tubes into the upper ends of reinforcing bushes fixed in the upper ends of the lower tubes. The upper ends of the pins are bent over to project laterally out of slots along the upper tubes and are externally provided with respective knobs whereby an attendant can raise the pins out of the lower tubes against the action of the springs to allow the two upper tubes to be hinged down rearwardly.

This latching arrangement is based upon linearly sliding parts and in practice is prone to jamming. Unfortunately, the looser the fit between the sliding parts in the latched, raised position of the backrest, and thus the less prone to jamming, the greater the degree of free movement between the sliding parts and thus the greater the amount of rattling during use of the wheelchair.

U.S. Pat. No. 4,164,354 discloses similar latching mechanisms in a folding wheelchair except that, instead of the latching mechanisms being at about seat level, they are at about arm rest level.

British Patent Specification No. 1203431 discloses a latching mechanism for a linkage comprised of first and second rectangular strips to the first of which is rivetted a triangular plate at an apex of which the second strip is pivotally mounted. On the second strip is also pivotally mounted a latching device consisting of two triangular plates fixed together by two posts. The nearer end of the first strip extends between the two plates and between the two posts in the latched condition, and the latching device is urged into that position by a torsion spring acting between the device and the second strip. One of the two plates has an edge zone bent over the outer edge of the second strip to form a latch-releasing flange for pressing by a user to move the outer post from the path of the nearer end of the first strip.

This mechanism is unsuitable for use in relation to a wheelchair backrest in that the elongate members of the linkage are not end-to-end in their latched condition, and thus the canvas material of the backrest could not be both smooth in that condition and well attached to the elongate members. Moreover, the patient would be liable to catch, or even hurt, himself on the projecting nearer end of the foremost one of the members. Another disadvantage of the mechanism is that the latching device can perform a significant amount of free movement relative to the first strip in the latched condition, giving a significant rattle problem.

SUMMARY OF THE INVENTION

According to the present invention, there is provided a folding aid for the disabled, including first and second aid parts which in a latched condition are disposed end-to-end, hinge means interconnecting said aid parts such that said parts are turnable relative to each other about an axis of said hinge means between the latched condition and a folded condition, latching means turnably mounted on the first aid part so as to be manually turnable relative thereto, and detent means mounted on the second aid part so as to be releasably engageable by said latching means so as to retain said aid parts in said latched condition, said latching means being biassed towards its condition in which it releasably engages said detent means.

Owing to the invention, a folding aid in which the aid parts are disposed end-to-end in their latched condition employs a turning latching action, so reducing the likelihood of jamming of the latching mechanism.

BRIEF DESCRIPTION OF THE DRAWINGS

In order that the invention may be clearly understood and readily carried into effect, reference will now be made, by way of example, to the accompanying drawings, in which.

DESCRIPTION OF THE PREFERRED EMBODIMENT

Figure 1:
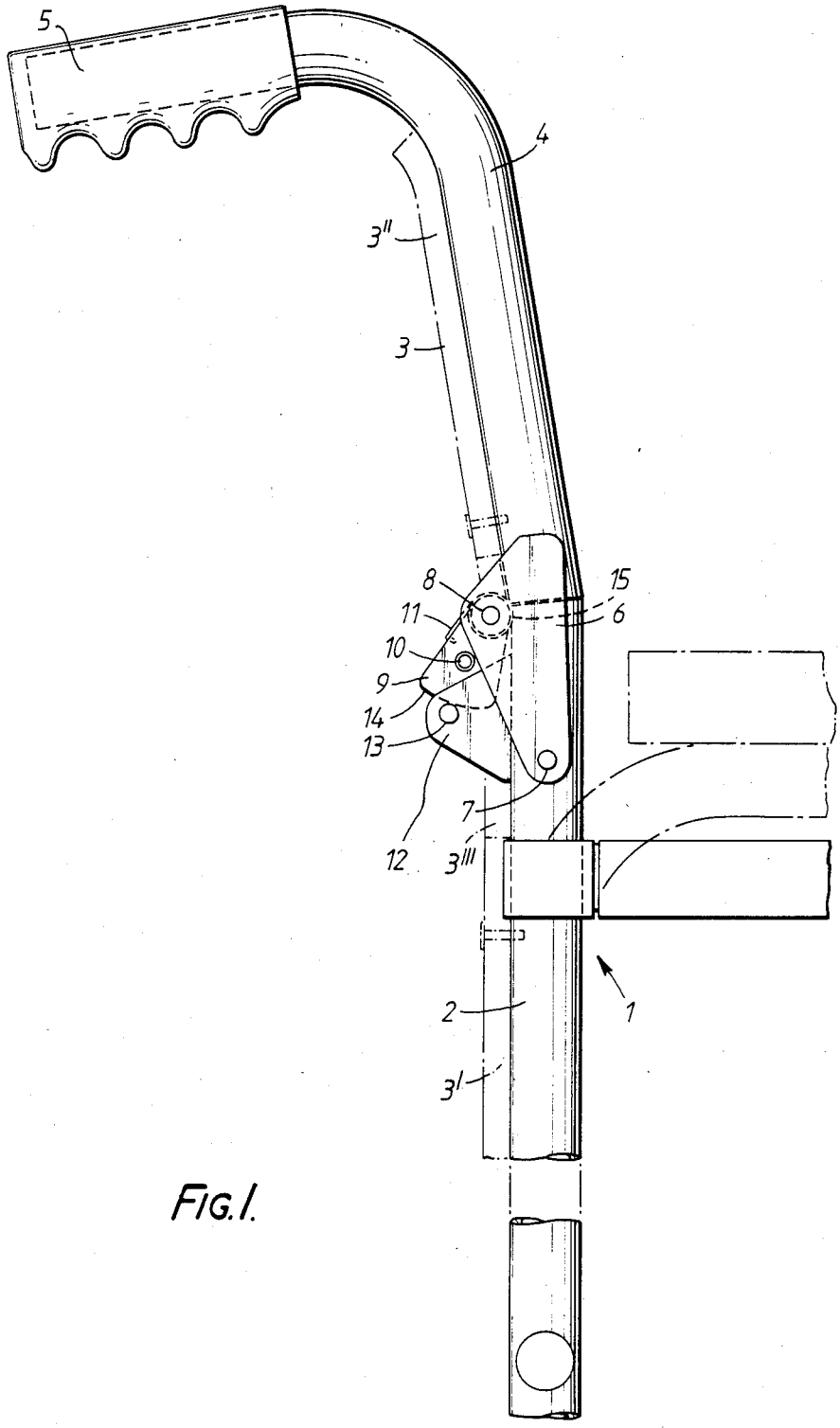
FIG. 1 shows a fragmentary side elevation of a folding backrest of a wheelchair, the backrest being in a raised condition.

Referring to the drawings, the wheelchair includes a folding frame 1 which itself includes two rear, vertical members 2 (of which only one is seen). A back 3 of flexible sheet material comprises a vertical, lower part 3 attached at respective vertical edge zones thereof to the rear of the respective members 2, a seat (not shown) of similar material being attached to respective horizontal members (not shown) of the frame 1. The back 3 also includes an upper part 3″ which, in the raised condition of the backrest, is slightly inclined rearwardly from the vertical. The part 3″ is attached at its two upwardly extending edge zones to respective bent tubes 4 (of which only one is seen) which are each provided with a handle 5 for grasping by an attendant. The back 3 has a cut-out 3‴ at each lateral side to receive a latching mechanism which will now be described. The inner end of each tube 4 has welded to its respective lateral sides vertical, parallel plates 6 each of a roughly triangular form, these plates 6 embracing the upper end of the adjacent member 2 and being pivotally connected thereto by a horizontal pivot pin 7 extending transversely of the wheelchair. These two pins 7 are co-axial with each other. Extending horizontally between the plates 6 of each pair is a pin 8 on which is pivotally mounted a vertical, substantially sectoral plate 9 to which is fixed a laterally outwardly projecting pin 10. A torsion spring 11 urges the plate 9 anticlockwise in the drawings. From the rear side of each member 2 projects a pair of vertical, parallel lugs 12 welded to the member 2 and interconnected by a horizontal pin 13.

The curved, outer peripheral edge surface 14 of the plate 9 is not truly concentric with the axis of the pin 8, which is the axis of turning of the plate 9. Either the surface 14 is a true arc of a cylinder but slightly eccentric relative to the axis of the pin 8, or the surface 14 varies slightly from being a true arc, but in either case such that its radius from its axis of turning increases gradually and slightly clockwise in the drawings.

Figure 2:
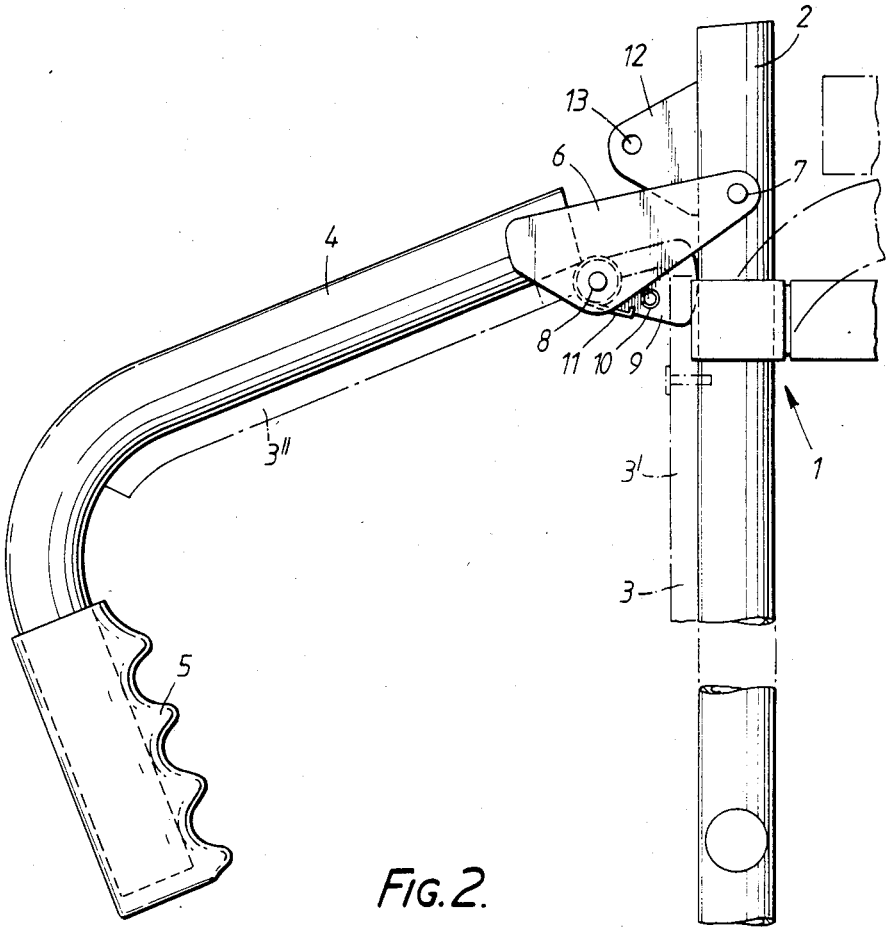
FIG. 2 is a view similar to FIG. 1, but showing the backrest in a lowered condition.

In use, an attendant can grasp the handles 5 and turn the parts 3'' and 4 about the pivot pins 7 to bring the backrest into either the raised condition shown in FIG. 1 or the lowered condition shown in FIG. 2. In the raised condition, the part 3'' is inclined slightly rearwardly from the vertical, so providing a more comfortable seating arrangement for the occupant than if it were truly vertical. Moreover, in that condition, each plate 9 extends downardly between the upper parts of the lugs 12 of its associated pair and bears with an upper substantially linear surface portion 15 thereof against the member 2 and, under the action of the spring 11, with a substantially linear portion of its surface 14 against the pin 13, so that he items 3'' and 4 are prevented from being rotated downwards about the pivot pin 7 by the plate 9 abutting downwardly against its associated pin 13. The portion 15 is part of and located part-way around an arcuate external peripheral surface of the plate 9 co-axial with the pin 8. From the raised condition, and in order to bring the backrest to its lowered condition, the attendant uses a finger to swing each pin 10 rearwards to swing the plate 9 beyond abutment with the pin 13, against the action of the spring 11, and then lowers the items 3'' and 4 about the pivot pins 7 into the lowered condition shown in FIG. 2, in which the plate 9 bears against the member 2 and the pin 10 abuts the adjacent plate 6. If the space into which the wheelchair is to be loaded is very restricted, the items 3'' and 4 can be further lowered if the plates 9 are kept swung to near the tubes 4. To return the items 3'' and 4 to their raised condition, the handles 5 are simply lifted to turn the items 3'' and 4 about the pins 7 and to cause the plates 9 to ride upwards over the rear sides of the pins 13 until they cammingly latch behind those pins 13, as in FIG. 1. Such camming effect obtained by the gradually increasing radius of the surface 14 from its axis of turning has the advantage of giving rigid locating of the tube 4 relative to the member 2 in the condition of FIG. 1, and thereby eliminating clearance without requiring precision manufacture and thereby also allowing wear of the plate 9 or the pin 13 during use to be taken up. Moreover, reliance upon the portion 15 abutting the member 2 to define the raised position of the tube 4 avoids reliance upon mutual abutting of the adjacent ends of the tube 4 and the member 2 to define such raised position, thereby avoiding the need for precision manufacture in the region of those ends.

I claim:

1. A folding aid for the disabled, including first and second aid parts which in a latched condition are disposed end-to-end, hinge means interconnecting said aid parts such that said parts are turnable relative to each other about an axis of said hinge means between the latched condition and a folded condition, latching means turnably mounted on the first aid part so as to be manually turnable relative thereto, and detent means mounted on the second aid part so as to be releasably engageable by said latching means so as to retain said aid parts in said latched condition, said latching means being biased towards it condition in which it releasably engages said detent means, wherein said latching means includes a curved camming surface by way of which said latching means bears on said detent means under its bias, said camming surface increasing in radius progressing away from said second aid part in said latching condition, thereby to take up play in said latching condition.

2. A folding aid for the disabled, including first and second aid parts which in a latched condition are disposed end-to-end, hinge means interconnecting said aid parts such that said parts are turnable relative to each other about an axis of said hinge means between the latched condition and a folded condition, latching means turnably mounted on the first aid part so as to be manually turnable relative thereto, and detent means mounted on the second aid part so as to be releasably engageable by said latching means so as to retain said aid parts in said latched condition, said latching means being biased towards it condition in which it releasably engages said detent means, wherein said latching means comprises a substantially sectorial plate whereof a radially outer peripheral surface bears on said detent means in said latched condition.

3. A folding aid according to claim 2, wherein said detent means comprises a pin extendinng substantially parallelly to an axis of turning of said latching means.

4. A folding aid according to claim 2 and in the form of a folding wheelchair, at least one of said aid parts being part of a backrest of said wheelchair.

5. A folding aid according to claim 4, wherein said first aid part is the upper of the aid parts in said latched condition and includes an attendant handle.

6. A folding aid according to claim 1, wherein said detent means comprises a pin extending substantially parallelly to an axis of turning of said latching means.

7. A folding aid according to claim 1 and in the form of a folding wheelchair, at least one of said aid parts being part of a backrest of said wheelchair.

* * * * *